US006923007B1

(12) United States Patent
Markham et al.

(10) Patent No.: US 6,923,007 B1
(45) Date of Patent: Aug. 2, 2005

(54) SYSTEM AND METHOD OF PUMPING LIQUIFIED GAS

(75) Inventors: Trevor K. Markham, San Antonio, TX (US); Glen M. Arnott, San Antonio, TX (US)

(73) Assignee: Daniel D. Holt, San Antonio, TX (US)

( * ) Notice: Subject to any disclaimer, the term of this patent is extended or adjusted under 35 U.S.C. 154(b) by 25 days.

(21) Appl. No.: 10/688,729

(22) Filed: Oct. 16, 2003

(51) Int. Cl.[7] ..... F17C 13/00
(52) U.S. Cl. ..... 62/50.6; 417/313
(58) Field of Search ..... 62/45.1, 50.1, 62/50.2, 50.6, DIG. 2; 417/313

(56) References Cited

U.S. PATENT DOCUMENTS

| | | | | |
|---|---|---|---|---|
| 3,633,372 | A * | 1/1972 | Kimmel et al. | 62/49.2 |
| T0,976,001 | I4 * | 11/1978 | Schuck | 62/50.6 |
| 4,726,506 | A * | 2/1988 | Kondo | 228/37 |
| 5,531,242 | A * | 7/1996 | Paganessi | 137/255 |
| 5,616,838 | A * | 4/1997 | Preston et al. | 73/195 |
| 5,954,101 | A * | 9/1999 | Drube et al. | 141/82 |
| 6,044,647 | A * | 4/2000 | Drube et al. | 62/50.1 |
| 6,354,088 | B1 * | 3/2002 | Emmer et al. | 62/50.1 |
| 6,631,615 | B2 * | 10/2003 | Drube et al. | 62/50.4 |
| 6,695,017 | B1 * | 2/2004 | Liedtke | 141/5 |
| 6,698,211 | B2 * | 3/2004 | Gustafson | 62/50.2 |
| 6,708,718 | B2 * | 3/2004 | Yamada et al. | 137/255 |
| 6,742,517 | B1 * | 6/2004 | Frye et al. | 128/201.21 |

FOREIGN PATENT DOCUMENTS

| | | | |
|---|---|---|---|
| JP | 404256895 A | * | 9/1992 |
| JP | 02002191337 A | * | 7/2002 |

* cited by examiner

*Primary Examiner*—William Doerrler
*Assistant Examiner*—Mohammad M. Ali
(74) *Attorney, Agent, or Firm*—Daniel D. Chapman; Jackson Walker L.L.P.

(57) ABSTRACT

A system and method of pumping liquified gas. Applicants systems includes a liquified gas storage vessel and a smaller high pressure high pressure liquified gas storage cylinder. Applicant provides a pump between the two vessels for pumping the liquified gas from one vessel to the other. Applicants system also includes at least one heat exchanger through which the liquified gas passes as it is pumped from one vessel to the other, which heat exchanger cools the liquified gas that is being pumped to a temperature typically below the vaporization point of the gas.

21 Claims, 5 Drawing Sheets

SYSTEM AND METHOD OF PUMPING LIQUIFIED GAS

FIELD OF INVENTION

Pumping systems, more specifically pumping method and devices for the movement of liquified gas into a high pressure cylinder.

BACKGROUND

In the compressed gas industry, there are two basic types of pressure vessels used to contain the gases; refrigerated and non-refrigerated. In the non-refrigerated storage vessels the gases are stored at atmospheric temperatures and they are generally kept at higher pressure than in the refrigerated vessels. Nearly all bulk gas is produced, transported, and stored in a refrigerated state. The actual temperatures that the gases are stored at varies by the type of gas, and can range from 0° F. to −350° F., but the principal of refrigerating a gas to maintain it as a low pressure liquid is similar with many types of gas. The benefits of keeping gasses as refrigerated liquids include more condensed storage and handling and lower pressure.

BRIEF DESCRIPTION OF THE INVENTION

Historically it has been the function of industrial gas fill plants to convert, or pump, the low pressure refrigerated liquefied gases into the non-refrigerated higher pressure vessels. These pumping stations are expensive to install and usually require the liquefied gas storage vessel to have an outlet port at the bottom of the vessel as well as a recirculation system to prevent vapor locking the pump (vaporizing the gas in the pump). Applicants system and process allows for the use of smaller refrigerated pressure vessels which have connections on the top of the pressure vessels and eliminates the need for a recirculating system, significantly reducing the cost of the pumping station.

All liquefied gases are stored in equilibrium between vapor and liquid phases; this equilibrium is maintained by a combination of temperature and pressure. There are established temperature-pressure charts for each gas which state the temperature-pressure relationship between the boiling point and the critical temperature (See Chart 1). As the liquefied gas is maintained at a point along the temperature-pressure chart, any reduction of pressure or increase in temperature causes the gas to vaporize. This vaporization impairs the ability to be able to "pump" the liquified gas. Conventionally, liquefied gases are gravity fed into the pump to reduce the possibility of the suction of the pump causing a vaporization of the gas. These pumps are also usually set to recirculate the pumped fluid back into the storage pressure vessel when there is no down stream need. This recirculation maintains the pump temperature consistent with that of the refrigerated liquefied gas. It becomes increasingly difficult to pump liquified gases from portable refrigerated storage vessels (Dewars) using conventional pumping setups as the connections for the Dewars is through the top and the liquid is withdrawn by means of as dip tube, or siphon tube which extends into the liquid at the bottom of the vessel. Extracting liquified gas from the Dewars up through the dip tube results in a slight loss of pressure. Compounding the inability to gravity feed the liquid is the difficulty in establishing any type of recirculating system using a Dewar, because standardized Dewars do not have a suitable port for a return line into the bottom of the vessel. The inability of establishing recirculating systems in Dewars previously has resulted in the pumps being warmer than the temperature of the liquified gas in the storage vessel, increasing the potential for vapor lock at the pump. Consequently the use of the Dewar cylinders has been restricted to a high volume end users, or use with expensive high volume pumps, and the conversion of low pressure liquefied gases into high pressure non-refrigerated cylinders is generally left to large scale industrial gas pumping stations.

Applicant's present invention makes use of a heat exchanger to sub cool the liquefied gas below its equilibrium point, stabilizing the liquid, preventing it from vaporizing as it is subjected to the pressure reduction and temperature increase on the suction side of the pump.

DETAILED DESCRIPTION OF APPLICANTS PREFERRED PROCESS

Figure 1:
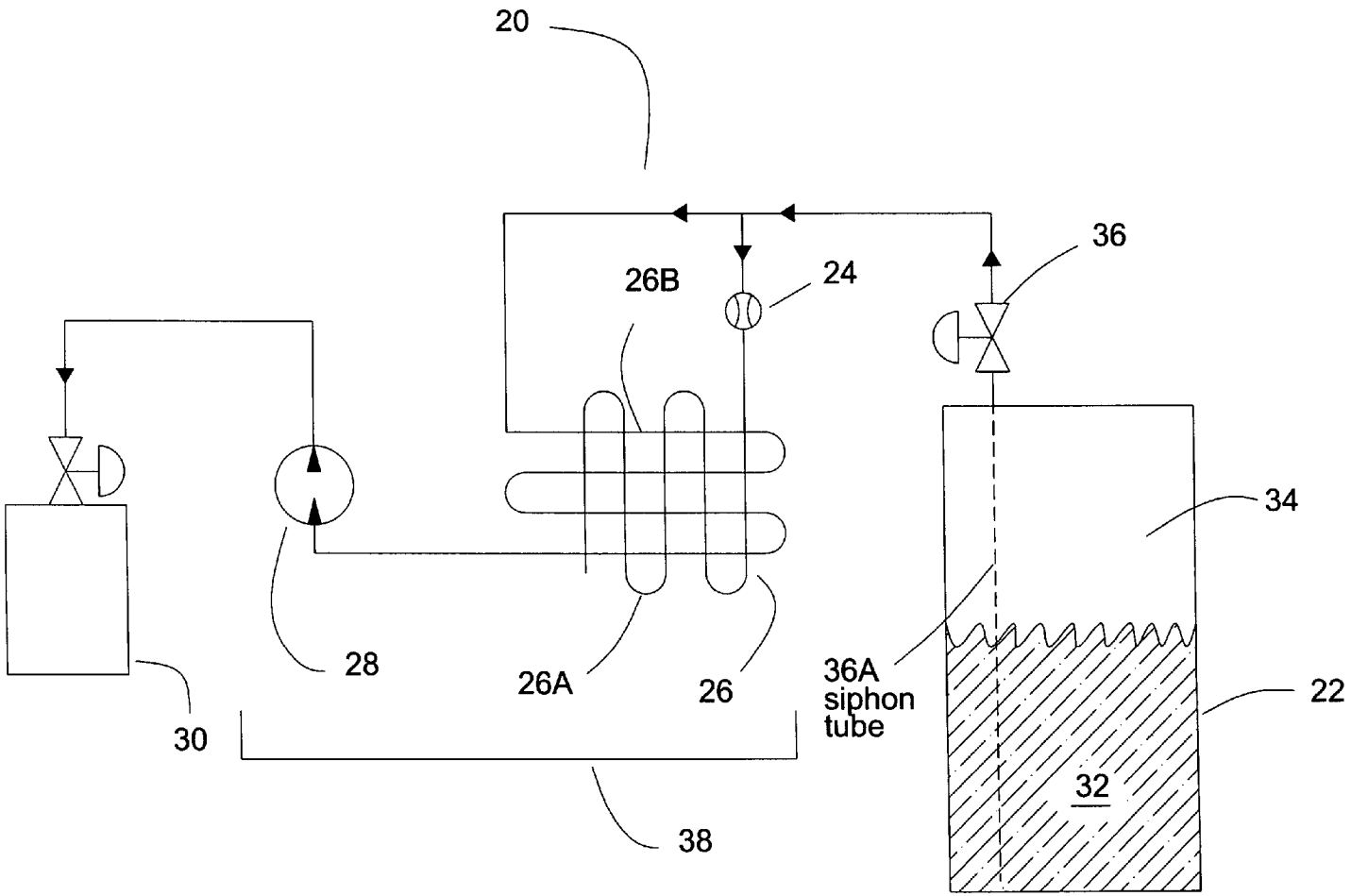
FIG. 1 is an illustration of applicants process and system for transferring a liquified gas from a large vessel to a small vessel, featuring a heat exchanger between the large vessel and the pump.

Chart 1 is a simplified temperature-pressure chart for Carbon Dioxide ($CO_2$). This chart graphs the equilibrium point between the boiling point (2) at 0 psig and −109.3° F. and the critical point (4) at 1056 psig and 87.9° F. The critical point is the point after which all liquid vaporizes without regard to pressure.

Often commercially available refrigerated $CO^2$ is stored at around 0° F. (6) resulting in a pressure of about 290 psig. Conventionally the industrial gas fill plants have pumped, or increased the pressure of this refrigerated liquefied $CO^2$ as it went into non-refrigerated cylinders at say 70° F., which results in a pressure increase of about 550 psig. When pumping care must be taken to ensure the liquid is not subjected to lower pressure (8) or higher temperatures (10) as this will cause the gas to vaporize, impeding the pumping process.

Applicants process and system makes use of a heat exchanger to subcool the liquid between the storage vessel and the pump (and/or between the pump and the non-refrigerated cylinder), lowering the temperature (12) whilst maintaining the pressure, moving the temperature of the liquid, via cooling, away from the equilibrium point and substantially into the liquid phase. This process and system of subcooling causes any liquid beginning to vaporize prior to the heat exchanger because of being warmed or drawn up a siphon tube to re-condense, and stay as a liquid throughout the pumping process.

FIGS. 1 though 5 provide, in schematic form, for the use of standardized components arranged to pump liquefied gases using applicants preferred process and systems. Turning to FIG. 1, we see applicants basic pumping system (2 heat exchanger (26), pump (28), and smaller, high pressure storage vessel (30). It is further noted that the liquefied gas inside of storage vessel (22) is typically maintained in equilibrium as a combination of liquid (32) and gaseous (34) phases. As is depicted, liquid valve (36) has attached siphon tube (36A) extending the inlet of liquid valve (36) into the liquid (32) inside storage vessel (22).

In operation FIG. 1 illustrates that the liquefied gas is extracted from storage vessel (22), through liquid valve (36) and is channeled towards heat exchanger (26). The head pressure in the refrigerated storage vessel is typically sufficient to drive the liquified gas to the pump. As the liquid approaches the heat exchanger it is divided and a portion of the liquid is sent to the flow controller (24) which restricts the flow into a vaporizing tube (26A) of heat exchanger (26) causing the liquid to vaporize, and absorbing heat as an expendable refrigerant vented into the atmosphere from the removed open end of the vaporization tube. The other portion of liquid is directed into a liquid tube (26B) of heat exchanger (26) and is divested of the heat energy required to vaporize the liquid in the vaporizing tube (26A) thereby cooling the liquid in the liquid tube. The liquid then exiting heat exchanger (26) in liquid tube (26B) is substantially sub cooled as it is directed towards the pump (28), and expendable refrigerant gas exiting heat exchanger (26) through vaporizing tube (26A) is simply exhausted. Pump (28) may be standard pump either electrically or pneumatically powered, such as a REHVAC PTF-400, and is used to boost the pressure of the sub cooled liquid and fill the smaller, typically non-refrigerated, storage vessel (30), typically to a higher pressure than storage vessel (22). Modular base (38) may be added to secure the heat exchanger (26), pump (28) and other related equipment to form a modular unit.

Figure 2:
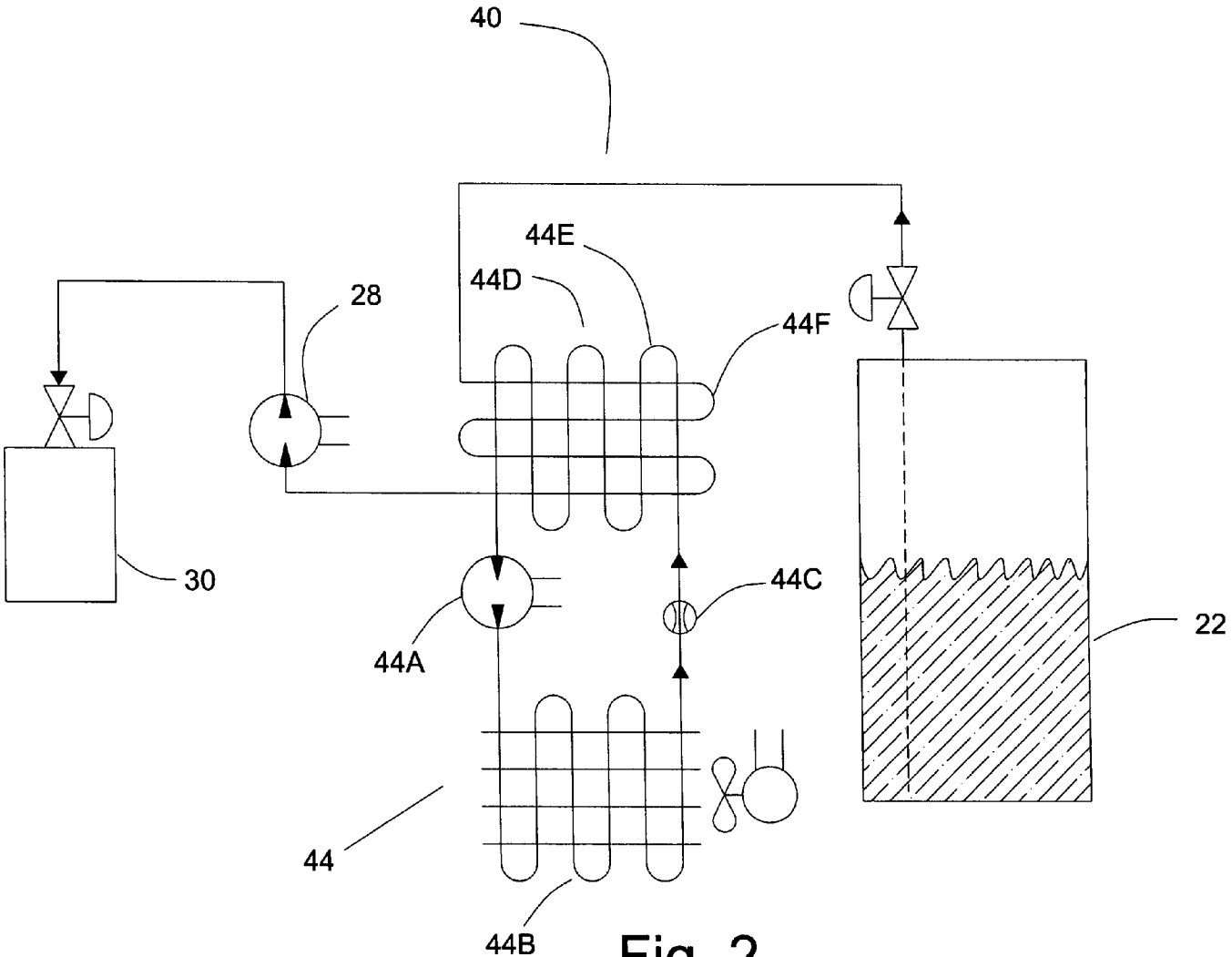
FIG. 2 is an illustration of applicants process and system for transferring a liquified gas from a large vessel to a small vessel, illustrating a recirculating refrigeration system including a compressor, condenser, and a flow restrictor adjacent the vaporizing tube of first heat exchanger.

FIG. 2 represents an alternative preferred embodiment of applicants process using a recirculating refrigeration system wherein the refrigerant gas is not exhausted, but rather recirculated and used again. Pumping process and system (40) includes storage vessel (22), pump (28) and smaller high pressure storage vessel (30) which are substantially the same as set forth in FIG. 1. The sub cooling of the liquefied gas is accomplished by recirculation refrigeration system (44) including compressor (44A), condenser (44B), flow restrictor (44C) and heat exchanger (44D), having vaporizing tube (44E) and liquid tube (44F). In operation, a secondary refrigerant gas is circulated through compressor (44A), and cooled in condenser (44B). Flow restrictor (44C) then allows the refrigerant gas to expand and vaporize in vaporizing tube (44E) of heat exchanger (44D), absorbing heat from liquid tube (44F), sub cooling the liquefied gas being pumped.

Figure 3:
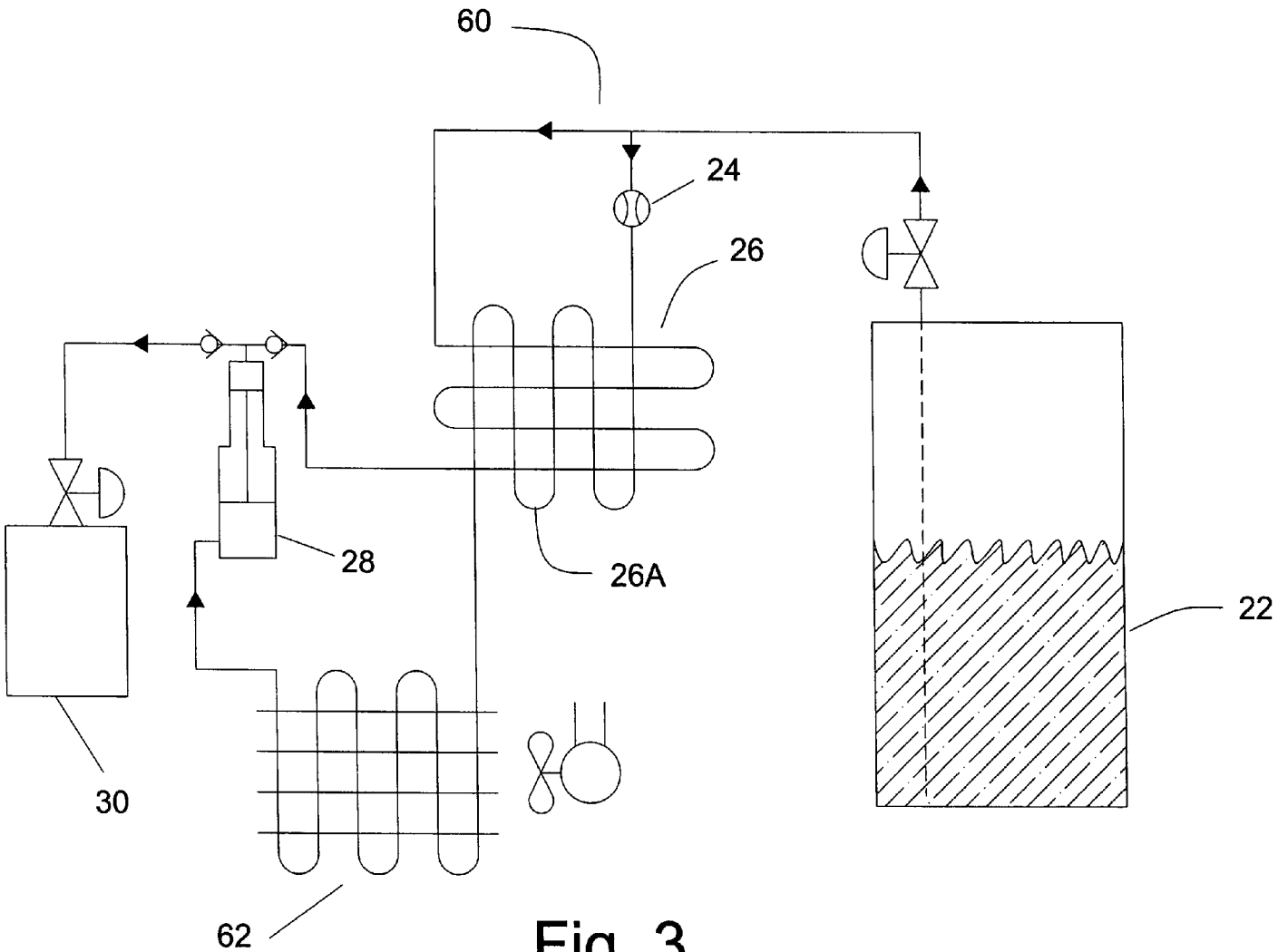
FIG. 3 illustrates applicants process and system of transporting a liquified gas from a large container to a smaller container using a pneumatic pump, the pneumatic pump being driven by gas downstream of the vaporization tube of the first heat exchanger.

FIG. 3 illustrates an alternate preferred embodiment of applicants process and system using the exhausted expendable refrigerant gas of FIG. 1 to power a pneumatically driven pump (20). In operation, pumping system (60) functions substantially the same as pumping system (20) of FIG. 1, having storage vessel (28), flow controller (24), heat exchanger (26), pump (28), and smaller high pressure storage vessel (30), although in the process and system pump (28) must be a pneumatically driven pump, which is optional in FIG. 1. In addition to the process and system in FIG. 1, we see, typically, warming coil (62) attached the exhaust of vaporizing tube (26A) which further warms and expands the exhausting gas, which is then used to power pump (28).

Figure 4:
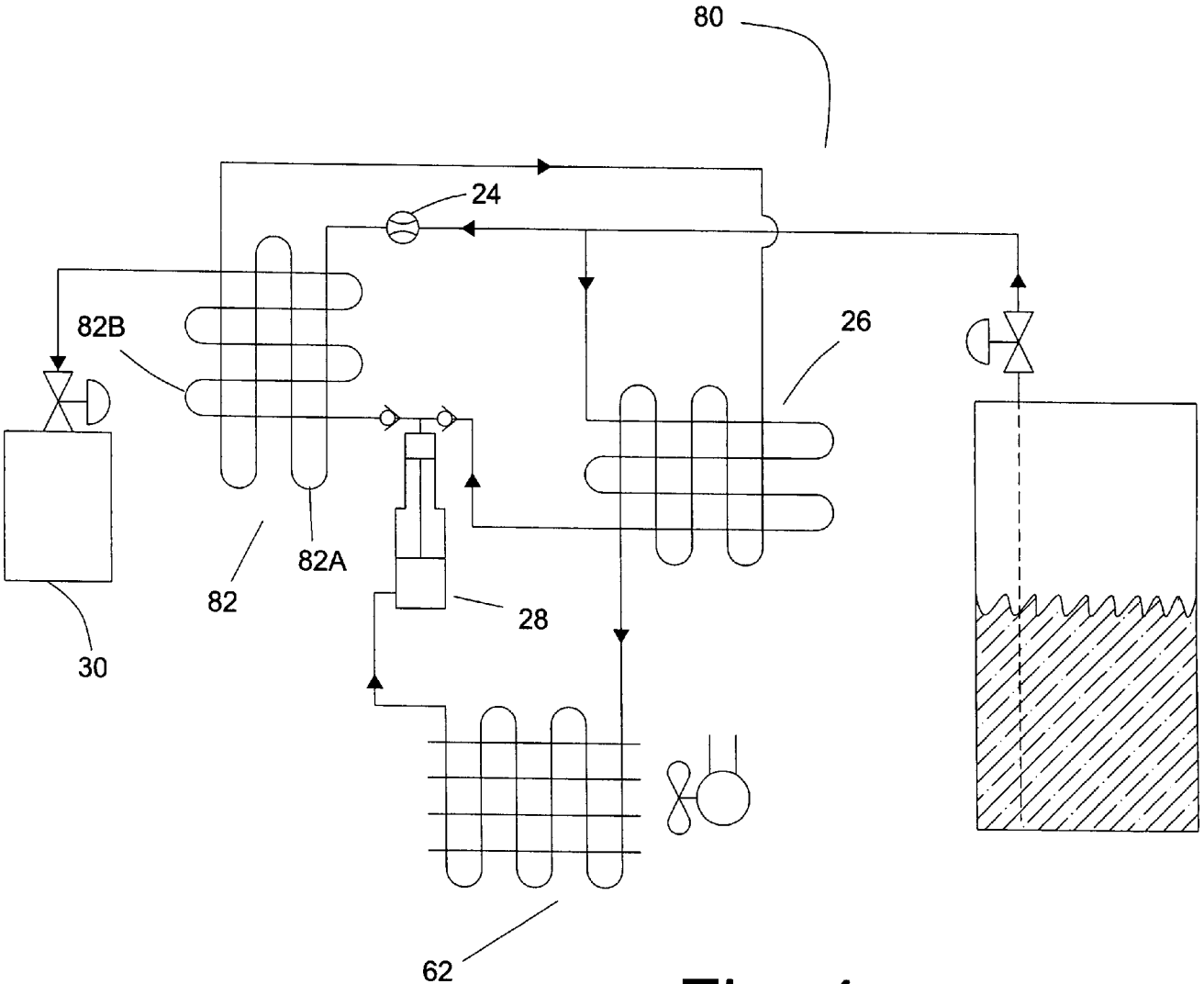
FIG. 4 illustrates an embodiment of applicants process and system which illustrates a first heat exchanger between the large vessel and the pump and the second heat exchanger between the pump and the small vessel both heat exchangers including the vaporization tube and both vaporization tubes downstream of the flow controller.

FIG. 4 illustrates a further enhancement on applicants process and system described in FIG. 3, allowing for a means to lower the pressure (without vaporization) in the smaller storage vessel (30) while it is being filled. Pumping process and system (80) includes a second heat exchanger (82) positioned between pump (28) and smaller high pressure storage vessel (30), having vaporizing tube (82A) and liquid tube (82B). Second heat exchanger (82) is used to further reduce the temperature of the liquefied gas downstream of the pump, ultimately cooling the smaller high pressure storage vessel (30). The lower temperature gas inside smaller high pressure storage vessel (30) results in a corresponding lower pressure making it easier for pump (28). After the filling process is over, smaller high pressure storage vessel (30) normalizes at regular atmospheric temperature and assumes the corresponding pressure. It is noted that the liquefied gas entering second heat exchanger (82) through flow controller (24) typically is not completely vaporized as it exits second heat exchanger (82) and enters heat exchanger (26) where it is still able to sub cool the liquefied gas prior to it being pumped at pump (28). From the heat exchanger (26) expendable refrigerant gas travels to coil (62) and on to pump (28) (pneumatic) similar to applicants process illustrated in FIG. 3.

Figure 5:
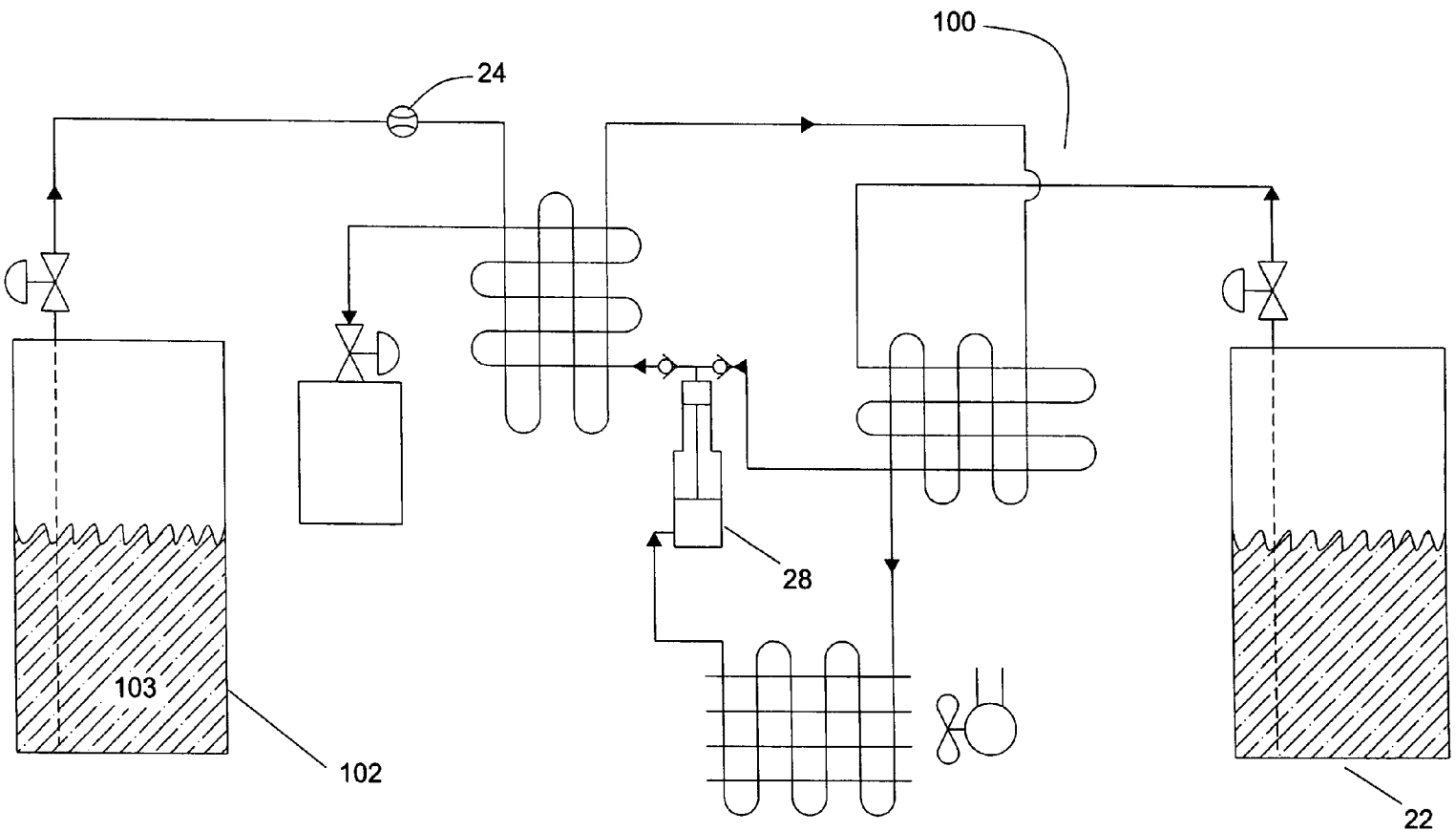
FIG. 5 illustrates an embodiment of applicants process and system incorporating a second large storage vessel. Liquified gas transferred from the first large storage vessel to the small storage vessel encounters a first heat exchanger before a pneumatically driven pump and a second heat exchanger between the pneumatically driven pump and the small container. Vaporization tubes for both heat exchangers receive liquified gas downstream of a flow controller from the second large storage vessel, which vaporization tube is in fluid communication with the pneumatic pump and drives the same.

FIG. 5 illustrates the use of second storage vessel, which is employed as the source of expendable refrigerant. During operation pumping process and system (100) is equipped with second storage vessel (102) which then feeds the expendable refrigerant (103) through flow controller (24) and through the process as set forth in pumping system (80) of FIG. 4. This process is employed when pumping more expensive gases such as Nitrous Oxide, and allows for the use of a lower cost expendable refrigerant to sub cool and drive the pump (28).

The types of liquified gases that may be pumped by applicants systems and processes are, for example: $CO_2$, $N_2O$, $N_2$ or $O_2$ or any other suitable gas. Flow controllers may be pressure regulators or expansion values, for example, or any other suitable device.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

What is claimed is:

1. A pumping system for pumping a liquified gas, the system comprising:

a first liquified gas storage vessel, adapted to store a composition as a liquified gas at a first temperature and a first pressure, the first temperature and first pressure being sufficient to maintain the composition as a liquified gas;

a high pressure storage vessel for receiving the liquified gas;

a pump in liquid communication with the liquified gas storage vessel and the high pressure storage vessel;

a first heat exchanger, to maintain the composition at a temperature below the vaporization point of the liquified gas.

2. The pumping system of claim 1 wherein the first heat exchanger further includes a liquid tube to carry at least some of the liquified gas from the liquified gas storage vessel to the pump and a vaporizing tube.

3. The pumping system of claim 2, further including a flow controller engaged with the vaporization tube of the first heat exchanger.

4. The pumping system as set forth in claim 2, further including a flow controller engaged with the vaporization tube of the first heat exchanger, wherein said flow controller is a pressure regulator.

5. The pumping system as set forth in claim 2, wherein said pump is a pneumatic pump.

6. The pumping system of claim 5, further comprising a warming coil disposed between the vaporizing tube of the first heat exchanger and the pump so that gas from the vaporizing tube drives said pneumatic pump.

7. The pumping system as set forth in claim 1, further comprising a second heat exchanger, the second heat exchanger including a liquid tube to carry at least some of the liquified gas from the pump to the high pressure storage vessel.

8. The pumping system as set forth in claim 7, wherein said pump is a pneumatic pump.

9. The pumping system of claim 8, further comprising a warming coil disposed between the vaporizing tube of the first heat exchanger and the pump so that gas from the vaporizing tube drives said pneumatic pump.

10. The pumping system as set forth in claim 7, further comprising a flow controller to control the flow of liquified gas to the second heat exchanger.

11. The pumping system as set forth in claim 10, wherein said flow controller is a pressure regulator.

12. The pumping system as set forth in claim 1, further including a second heat exchanger including a liquid tube for carrying at least some of the liquified gas from the gas storage vessel to the high pressure storage vessel.

13. The pumping system as set forth in claim 1, further comprising a unified, modular support base for engagement and support of at least the pump and the first heat exchanger.

14. The pumping system of claim 1 wherein the first liquified gas storage vessel and the high pressure storage vessel are adapted to contain liquified Carbon Dioxide.

15. A process for transferring a liquified gas from a refrigerated storage vessel that maintains the liquified gas at a first temperature and a first pressure to a smaller storage vessel the process comprising the steps of:

pumping the liquified gas from the refrigerated storage vessel to the smaller storage vessel; through a pump located between the two vessels; and cooling the liquified gas to a temperature below the first temperature as it is being pumped from the refrigerated storage vessel to the smaller storage vessel.

16. The process as set forth in claim 15 wherein the cooling step includes the step of providing a first heat exchanger, and passing the liquified gas through the first heat exchanger.

17. The process as set forth in claim 16 further including vaporizing a portion of the liquified gas of the refrigerated storage vessel in a vaporization tube.

18. The process as set forth in claim 16 wherein the vaporization tube of the vaporizing step is part of the first heat exchanger of the providing step.

19. The process of claim 17 wherein the vaporization tube of the vaporizing step is engaged with the pump of the pumping step to drive the same.

20. The process of claim 16 wherein the first heat exchanger is located between pump and the refrigerated storage vessel and further including a second heat exchanger, the second heat exchanger located between the pump and the smaller storage vessel.

21. The process of claim 15 wherein the liquified gas of the pumping and cooling steps is Carbon Dioxide.

* * * * *